US005762043A

United States Patent [19]

Yoshioka et al.

[11] Patent Number: 5,762,043

[45] Date of Patent: Jun. 9, 1998

[54] ENGINE FUEL INJECTION CONTROLLER

[75] Inventors: Yoshiaki Yoshioka, Sagamihara; Hatsuo Nagaishi, Yokohama, both of Japan

[73] Assignee: Nissan Motor Co., Ltd., Kanagawa, Japan

[21] Appl. No.: 780,080

[22] Filed: Dec. 23, 1996

[30] Foreign Application Priority Data

Jan. 9, 1996 [JP] Japan ..... 8-001691

[51] Int. Cl.[6] ..... F02D 41/04

[52] U.S. Cl. ..... 123/325; 123/493; 477/111; 477/181

[58] Field of Search ..... 123/325, 326, 123/493, 332, 333; 477/111, 181

[56] References Cited

U.S. PATENT DOCUMENTS 4,388,906 6/1983 Sugiyama et al. ..... 123/493
4,508,088 4/1985 Hasegawa et al. ..... 123/493
4,995,366 2/1991 Manaka et al. ..... 123/493
5,035,225 7/1991 Mizukoshi ..... 123/493

FOREIGN PATENT DOCUMENTS 5-71402 3/1993 Japan .

*Primary Examiner*—Andrew M. Dolinar
*Attorney, Agent, or Firm*—Lowe, Price, LeBlanc & Becker

[57] ABSTRACT

A fuel injection amount in an engine is determined based on a cylinder air volume equivalent fuel injection amount and a wall flow correction amount. The fuel injection amount is also decreased in an initial injection when fuel injection is restarted after it is has been stopped. In this way, sudden torque increases are suppressed without causing a loss of engine rotation speed when fuel injection is restarted after it has been stopped.

5 Claims, 9 Drawing Sheets

ENGINE FUEL INJECTION CONTROLLER

FIELD OF THE INVENTION

This invention relates to fuel feed control when fuel supply to an engine is restarted from a fuel cut condition.

BACKGROUND OF THE INVENTION

In an automobile engine, some time is required until the air-fuel ratio reaches a target air-fuel ratio when fuel injection is restarted from a fuel cut condition. During this time the air-fuel ratio is lean, and as it may not be possible to obtain ignition, the engine speed may fall.

This can be explained in more detail as follows.

During fuel cut, fuel which adhered to wall surfaces and valves before fuel cut flows into the cylinders, and when fuel injection starts again, there is almost no fuel adhering to wall surfaces and valves. However when fuel injection is restarted, some of the injected fuel becomes wall flow, and this wall flow enters the cylinders later than vaporized fuel which enters the cylinders immediately. Hence, the air-fuel ratio needs some time to reach its target value immediately after fuel injection restart and during this time interval the air-fuel ratio is lean.

To resolve this problem, Tokkai Hei 5-71402 published by the Japanese Patent Office in 1993 proposes increasing a wall flow correction amount when fuel injection is restarted after fuel cut. The wall flow correction is based on a variation of a basic fuel injection amount relative to the amount of air aspirated to the cylinders, and on engine cooling water temperature. The basic fuel injection amount is then corrected with the wall flow correction amount in order to obtain the final fuel injection amount for each cylinder.

In the calculation of wall flow correction, by correcting a stored value of the basic fuel injection amount to be smaller depending on the fuel cut time period, a difference or variation from a current-calculated value is set large, and the wall flow correction amount is thereby increased.

This enables the air-fuel ratio to reach its target value more rapidly after restarting fuel injection.

In general, the air aspirated into the cylinder of an engine when the intake stroke is completed contains a part of the combustion gases produced in the immediately preceding combustion.

One reason for this is that the opening periods of the exhaust valves and intake valves overlap with one another at the end of the exhaust stroke, therefore some of the combustion gas flows into the intake passage and is again led into the cylinder when it comes to the intake stroke.

Another reason is that the volume of a combustion chamber in the cylinder is not zero even at the end of the exhaust stroke so that some combustion gas remains in the combustion chamber.

However during fuel cut, combustion does not take place, consequently exhaust gas does not remain in the cylinder and the cylinder is full of fresh air when fuel injection is restarted. Therefore, if a large wall flow correction is applied when fuel injection is performed, an excessive torque is generated which gives a shock to the driver of the vehicle and its passengers.

SUMMARY OF THE INVENTION

It is therefore an object of this invention to suppress shock when fuel injection is restarted from a fuel cut condition.

It is a further object of this invention to prevent the aforesaid shock without causing a decline of engine speed.

In order to achieve the above objects, this invention provide a fuel injection controller for such an engine that comprises a cylinder, a fuel injector which performs fuel injection in synchronism with a combustion cycle of the cylinder and a mechanism for stopping the fuel injection under a predetermined engine running condition. The controller comprises a mechanism for calculating a cylinder air volume equivalent fuel injection amount corresponding to an air volume aspirated into the cylinder, a mechanism for calculating a wall flow correction amount, a mechanism for calculating a final fuel injection amount from the cylinder air volume equivalent fuel injection amount and the wall flow correction amount, a mechanism for controlling the fuel injector such that the injector injects the final fuel injection amount, and a mechanism for decreasing the final fuel injection amount in the initial injection when fuel injection is restarted after fuel injection is stopped by the stopping mechanism.

It is preferable that the controller further comprises a mechanism for detecting an engine cooling water temperature and a mechanism for calculating a fuel injection restart correction coefficient of which the value is different in the initial injection and in other injections, and the wall flow correction amount calculating mechanism comprises a mechanism for calculating a variation of the cylinder air volume equivalent fuel injection amount, a mechanism for calculating a water temperature correction coefficient according to the engine cooling water temperature, and a mechanism for computing a wall flow correction amount in the cylinder from the variation, water temperature correction coefficient and fuel injection restart correction coefficient.

In this case, it is further preferable that the mechanism for calculating a variation of the cylinder air volume equivalent fuel injection amount comprises a mechanism for storing a cylinder air volume equivalent fuel injection amount calculated for the previous fuel injection mechanism for calculating a difference between the cylinder air volume equivalent fuel injection amount calculated for a present injection and the cylinder air volume equivalent fuel injection amount stored by the storing mechanism and a mechanism for progressively decreasing the cylinder air volume equivalent fuel injection amount stored by the storing mechanism as the combustion cycle proceeds during a period in which fuel injection is stopped by the stopping mechanism.

As for the engine connected to a transmission, it is preferable that the controller further comprises a mechanism for detecting a gear position of the transmission, and the decreasing mechanism comprises a mechanism for correcting the wall flow correction amount such that the final injection amount becomes smaller the lower the gear position used.

When the engine comprises a torque converter comprising a lockup clutch, it is preferable that the controller further comprises a mechanism for detecting lockup of the lockup clutch, and the decreasing mechanism comprises a mechanism for correcting the wall flow correction amount such that the final injection amount is smaller during lockup.

The details as well as other features and advantages of this invention are set forth in the remainder of the specification and are shown in the accompanying drawings.

DESCRIPTION OF THE PREFERRED EMBODIMENTS

Figure 1:
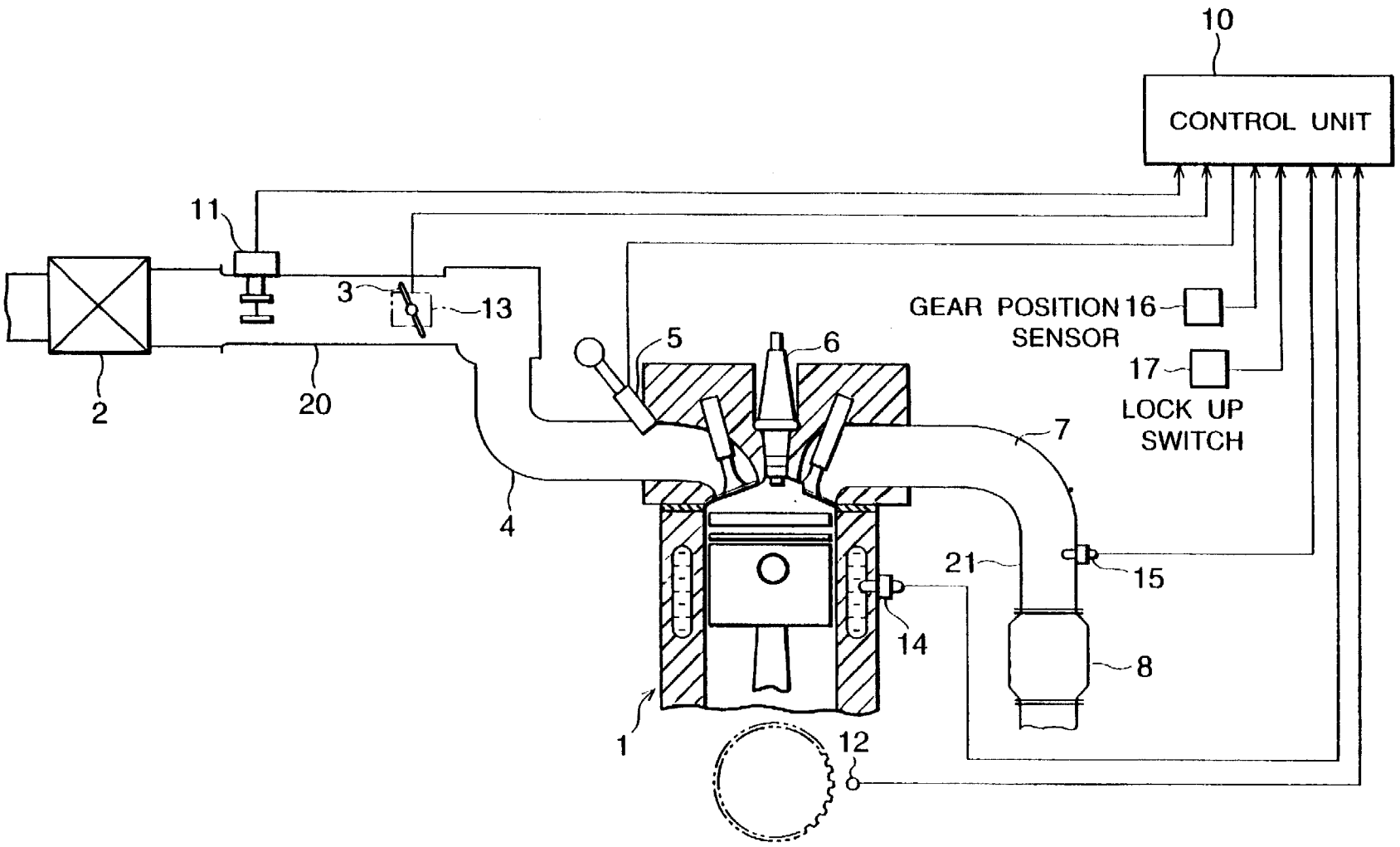
FIG. 1 is a schematic diagram of a fuel injection controller according to this invention.

Referring to FIG. 1 of the drawings, a 4 stroke cycle water-cooled automobile engine 1 aspirates air from an air cleaner 2 via an intake passage 20 and intake manifold 4. A throttle 3 connected to an accelerator pedal is provided in the intake passage 20 to vary the amount of intake air.

A fuel injector 5 is provided in each branch of the intake manifold 4 which runs to each cylinder. The fuel injector 5 is an electromagnetic valve which is open and shut by the magnetic force of a solenoid, the opening time and period of this valve being varied according to a pulse signal output by a control unit 10.

Fuel is constantly supplied at a predetermined pressure to the fuel injector 5 from a fuel pump, not shown, via a regulator, and fuel is injected at a predetermined pressure into the branch of the manifold when the fuel injector opens.

A spark plug 6 is provided in each cylinder of the engine 1. The fuel mixed with air which is led into the cylinder is ignited by the spark plug 6, and burns. Burnt gas is led to a catalytic converter 8 through an exhaust manifold 7 and exhaust passage 21, and after toxic components, i.e. carbon monoxide (CO), hydrocarbons (HC) and nitrogen oxides (NOx) have been removed by a three-way catalyst in the catalytic converter 8, the exhaust is discharged into the atmosphere.

A control unit 10 comprises a microcomputer, and controls the fuel injection amount of the injector 5 based on signals from various sensors.

One of these sensors is a hot wire air flow meter 11 for detecting an intake air volume Q which is installed in the intake passage 20 upstream of the throttle 3, and a crank angle sensor 12 is also provided to detect the rotation angle of a crankshaft, not shown. The crank angle sensor 12 outputs a REF signal every 180 degrees, and a POS signal every 1 or 2 degrees of the crankshaft rotation.

The control unit 10 detects an engine speed N of the engine 1 and a piston position in each cylinder by counting these signals. A potentiometer type throttle opening sensor 13 for detecting a throttle opening TVO is provided in the throttle 3. The throttle opening sensor 13 comprises an idle switch which switches ON in the fully shut position of the throttle 3.

A water temperature sensor 14 is provided in a water jacket of the engine 1 to detect a cooling water temperature Tw of the engine 1.

An oxygen sensor 15 is provided in an exhaust passage 21. The oxygen sensor 15 detects, from the oxygen concentration of the exhaust, detects whether the fuel mixture supplied to the cylinders is rich or lean relative to a stoichiometric air fuel ratio.

For the second and third embodiments described hereafter, a gear position sensor 16 for detecting a gear position of a transmission and a lockup switch 17 are provided. The lockup switch 17 detects the state of a lockup clutch which directly connects the input/output shafts of the torque converter of the automatic transmission under predetermined conditions, so in automobiles with manual transmission which do not have a torque converter, the lockup switch 17 is not provided.

The signals from all of these sensors are input to the control unit 10.

Based on these signals, the control unit 10 computes a fuel injection amount of the fuel injector 5 according to routines shown by the flowcharts of FIGS. 2–6, and controls the fuel injector 5 by outputting a pulse signal so as to inject the computed amount of fuel.

These routines will now be described.

Figure 2:
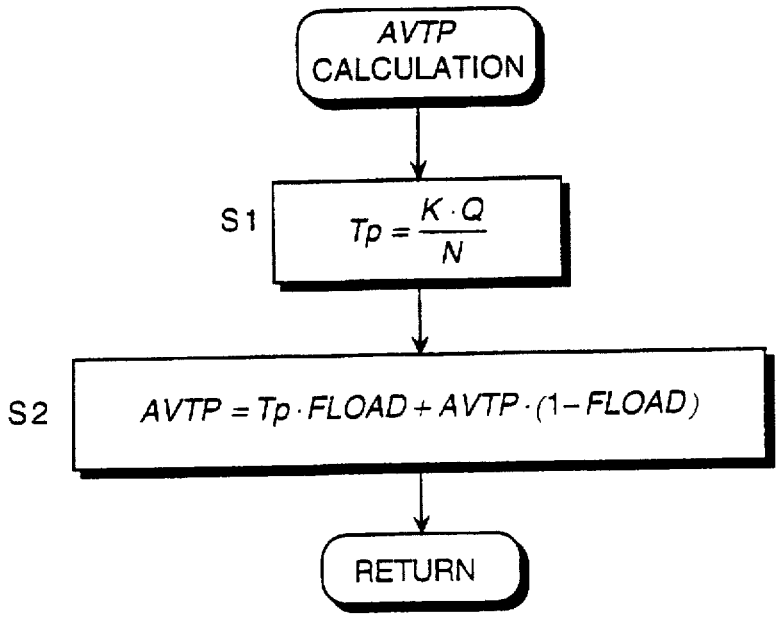
FIG. 2 is a flowchart describing a process for calculating a cylinder air volume equivalent fuel injection amount AVTP performed by the controller.

FIG. 2 is a routine for computing a cylinder air volume equivalent fuel injection amount AVTP which is executed for example every 10 ms.

In a step S1, a basic fuel injection amount Tp is calculated based on the intake air amount Q detected by the air flow meter 11 and the engine speed N detected by the crank angle sensor 12, as follows:

$$Tp = \frac{K \cdot Q}{N}$$

where, K is a constant.

In a step S2, the basic injection amount Tp is processed by the following first order delay equation taking account of the reaction delay between the value detected by the air flow meter 11 and the air actually aspirated by the cylinder, and a cylinder intake air volume equivalent fuel injection amount AVTP corresponding to the actual cylinder intake air volume, is calculated.

$$AVTP = Tp \cdot FLOAD + AVTP \cdot (1 - FLOAD)$$

where, FLOAD=weighted average coefficient determined by the throttle opening TVO and engine rotation speed N $$(0 < FLOAD \leq 1).$$

Figure 3:
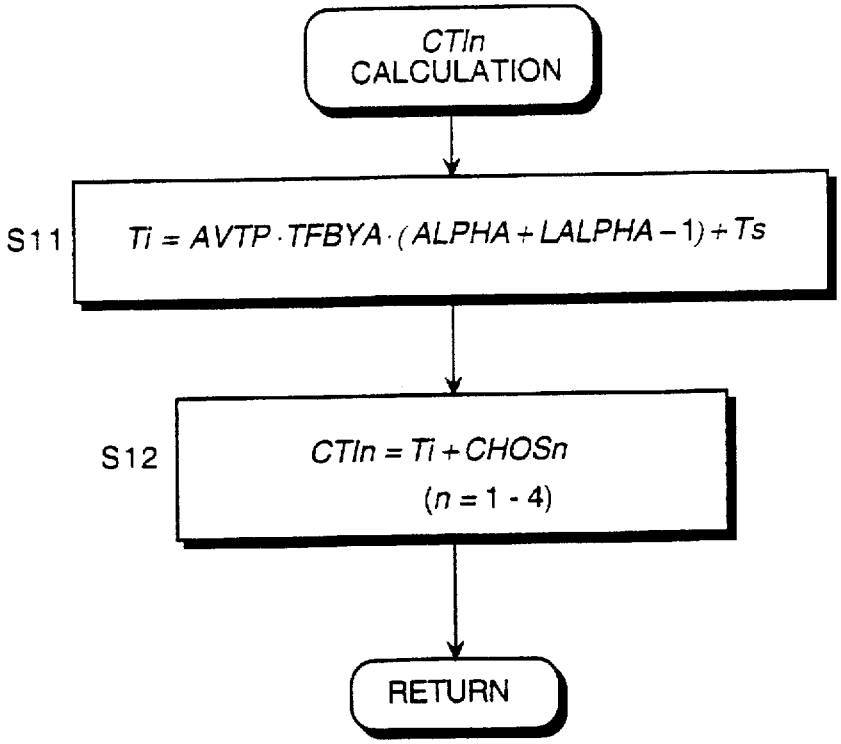
FIG. 3 is a flowchart describing a process for calculating a cylinder specific fuel injection amount CTIn performed by the controller.

FIG. 3 is a routine for calculating a cylinder specific fuel injection amount CTIn, and is executed at intervals of e.g. 10 ms as in the case of the routine of FIG. 2.

In a step S11, a fuel injection pulse width Ti is calculated based on the cylinder intake air volume equivalent fuel injection amount AVTP obtained by the process of FIG. 2, using the following equation.

$$Ti = AVTP \cdot TFBYA \cdot (ALPHA + LALPHA - 1) + Ts$$

where, TFBYA=air-fuel ratio correction coefficient

ALPHA=air-fuel ratio feedback correction coefficient

LALPHA=learning correction coefficient

Ts=ineffectual pulse width (voltage compensation) depending on battery voltage.

In a step S12, a cylinder specific wall flow correction amount CHOSn described hereafter is added to the fuel injection pulse width Ti to calculate a final cylinder specific fuel injection amount CTIn. n is the cylinder number to which a value ranging from 1 to 4 is assigned in a 4-cylinder.

$$CTIn=Ti+CHOSn$$

Figure 4:
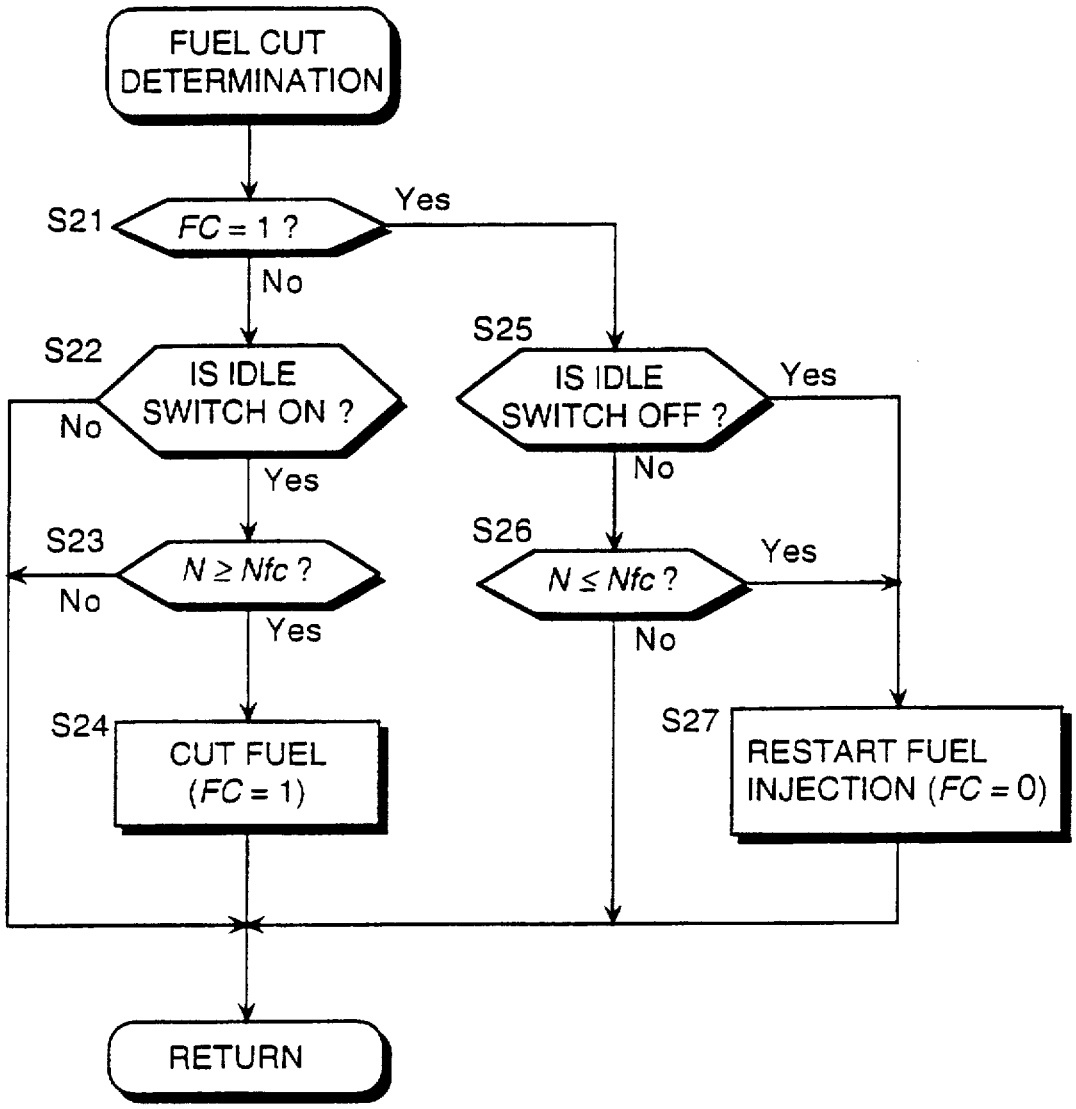
FIG. 4 is a flowchart describing a determining process related to fuel cut performed by the controller.

FIG. 4 is a routine which performs determinations related to fuel cut. This routine is also executed at intervals of for example 10 ms.

In a step S21, it is determined whether or not fuel cut is in progress. More specifically, it is determined whether or not a fuel cut flag FC is 1 or 0. When FC=0, it is determined in a step S22 whether or not the idle switch is ON or OFF, and in a step S23, it is determined whether or not the engine speed N is equal to or greater than a predetermined fuel cut rotation speed Nfc.

The routine proceeds to a step S24 only when the idle switch is ON, i.e. when the throttle is fully closed, and the engine rotation speed is equal to or greater than the predetermined value Nfc. The fuel cut flag FC is then set to 1, and fuel supply is cut.

When FC=1, it is determined in a step S25 whether or not the idle switch is OFF, and in a step S26, it is also determined whether or not the engine speed N is less than the predetermined value Nfc.

When the idle switch is OFF, i.e. when the accelerator pedal is depressed, the fuel cut flag FC is set to 0 in a step S27, fuel cut is released and fuel injection is restarted. Even when the engine rotation speed is less than the predetermined value Nfc in the step S26, the same process is performed in the step S27.

Hence, while fuel cut is in progress, the fuel cut flag FC is 1, and when fuel cut is released, the fuel cut flag FC is set to 0.

Figure 5:
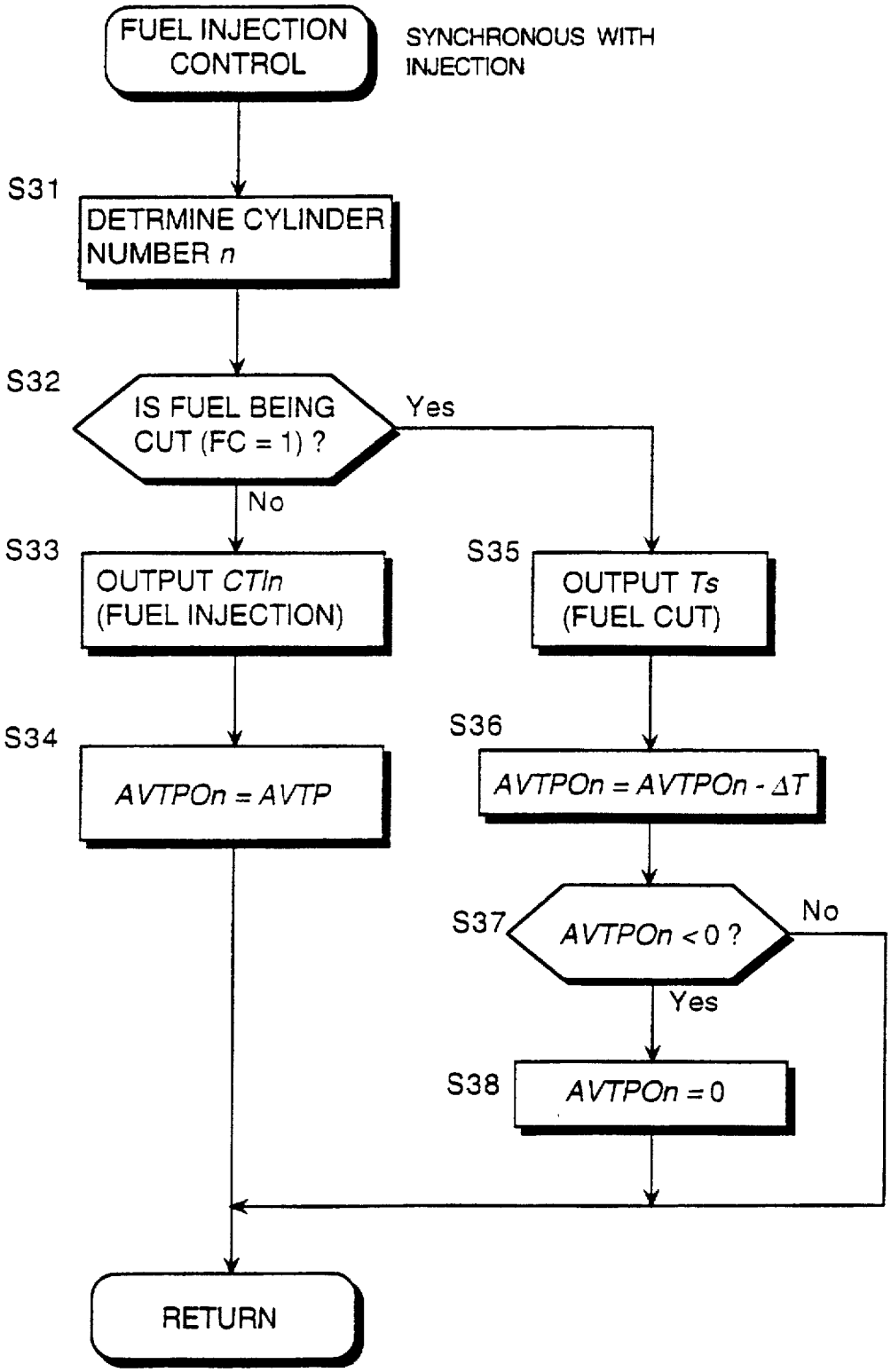
FIG. 5 is a flowchart describing a fuel injection control process performed by the controller.

FIG. 5 is a fuel injection control routine. This routine is performed prior to fuel injection in each cylinder and for each fuel injection.

In this routine, the number n of the cylinder to be controlled is first determined in a step S31.

In a step S32, it is determined whether or not fuel cut is in progress, i.e. whether or not FC=1.

When FC=0, a pulse signal having a pulse width corresponding to the cylinder specific fuel injection amount CTIn is output in a step S33 to the fuel injector 5 in the cylinder #n. Also in a step S14, a current cylinder intake air volume equivalent fuel injection amount AVTP is stored as a cylinder air volume equivalent fuel injection amount AVTPOn in the immediately preceding fuel injection for the same cylinder.

When FC=1, only a pulse signal corresponding to the ineffectual pulse width Ts is output to the fuel injector 5 of cylinder n in a step S35, and fuel injection is not performed. In this case, a cylinder intake air volume fuel equivalent amount obtained by subtracting a predetermined amount Δt from the cylinder air volume fuel equivalent amount AVTPOn on the immediately preceding occasion is stored as a new value AVTPOn in a step S36. However when the result of the subtraction is negative in a step S37, AVTPOn is set to 0 in a step S38.

Figure 6:
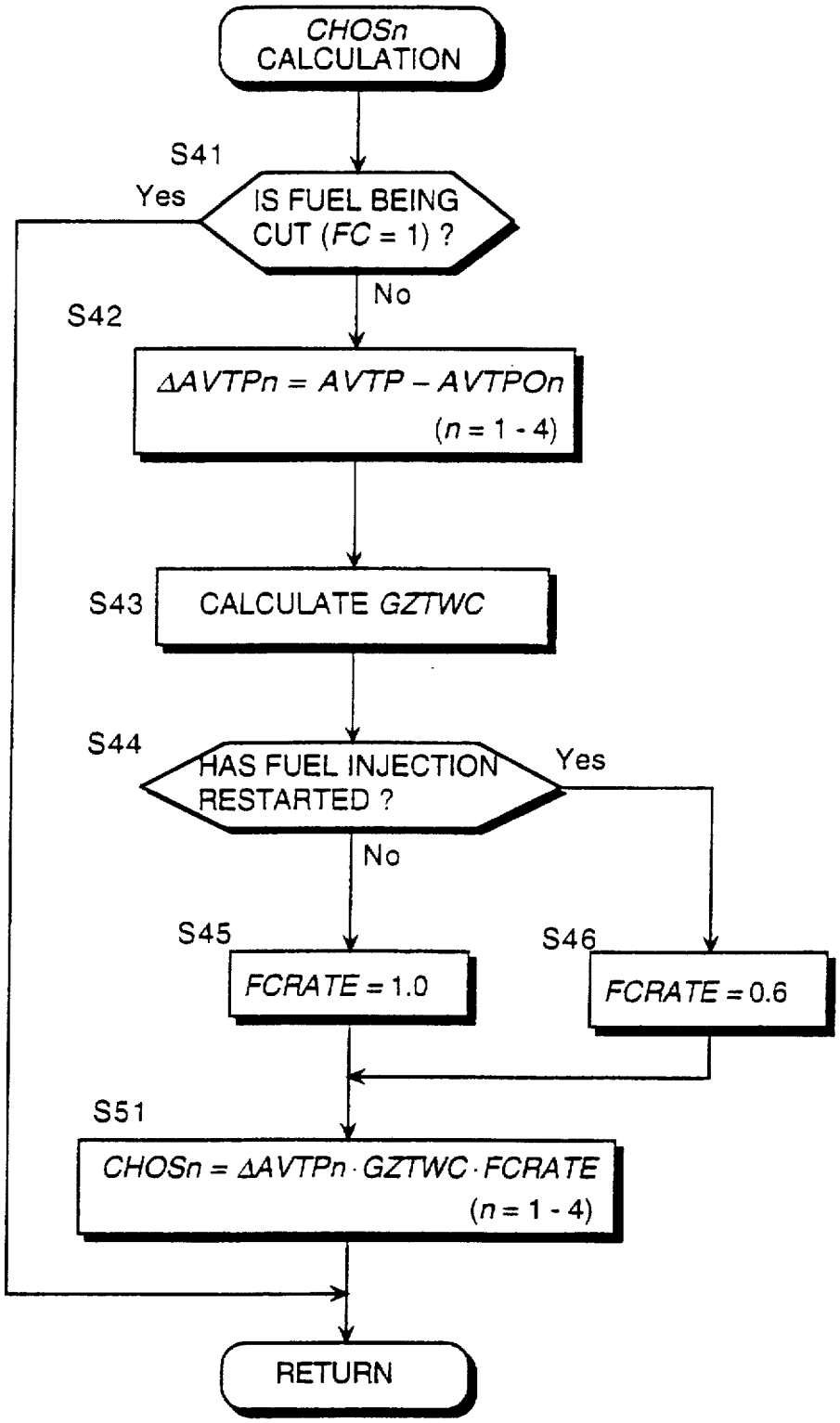
FIG. 6 is a flowchart describing a process for calculating a cylinder specific wall flow correction amount CHOSn performed by the controller.

FIG. 6 is a routine for calculating the cylinder specific wall flow correction amount CHOSn. This routine is executed at intervals of for example 10 ms as in the case of the routine of FIG. 2.

In a step S41, it is determined whether or not a fuel cut flag FC=1, i.e. whether or not fuel cut is in progress. When FC=1, the routine is terminated.

When FC=0, a variation amount ΔAVTPn of the cylinder air volume equivalent fuel injection amount AVTP for each cylinder is calculated in a step S42.

$$\Delta AVTPn=AVTP-AVTPOn$$

where, n is the cylinder number, and the calculation is performed from ΔAVTPO1 to ΔAVTPO4 for a 4-cylinder engine.

Next in a step S43, a table of water temperature correction coefficients GZTWC is looked up from the cooling water temperature Tw.

Figure 7:
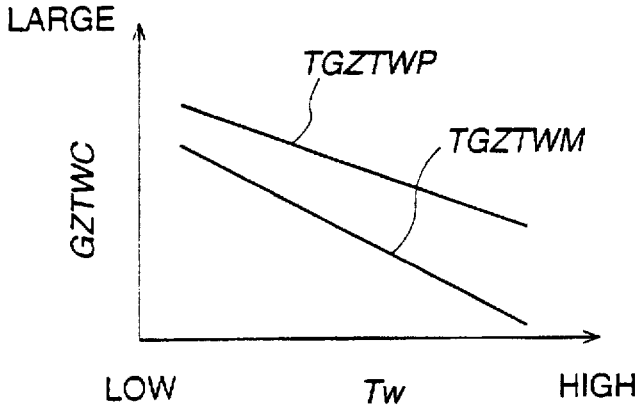
FIG. 7 is a diagram showing the contents of a table of water temperature correction factors GZTWC stored by the controller.

As shown in FIG. 7, the table of water correction coefficients GZTWC is set to reflect the characteristics of TGZTWP in the figures when ΔAVTPn≧0, i.e. when the vehicle is running steadily or accelerating, and to reflect the characteristics of TGZTWM in the figures when ΔAVTPn<0, i.e. when the vehicle is decelerating. Therefore, either one of these tables is selected depending on the value of ΔAVTPn so as to determine the water temperature correction coefficient GZTWC. In both of these tables, the water temperature coefficient GZTWC is set larger the lower the cooling water temperature Tw.

Next, in a step S44, it is determined whether or not fuel injection has restarted from the fuel cut state. When FC=1 in the immediately preceding determination, and FC=0 in the present determination, it is determined that fuel injection has restarted.

When it is determined that fuel injection has not restarted, a fuel injection restart correction coefficient FCRATE is set to 1.0 in a step S45, and the routine proceeds to a step S51.

When it is determined that fuel injection has restarted, FCRATE is set to 0.6 in a step S46, and the routine proceeds to the step S51.

In the step S51, the cylinder specific wall flow correction amount CHOSn is calculated from the following equation:

$$CHOSn=\Delta AVTPn\cdot GZTWC\cdot FCRATE$$

Hence by adding the fuel injection restart correction coefficient FCRATE to the equation for calculating the cylinder specific wall flow correction amount CHOSn and varying FCRATE according to whether or not fuel injection has restarted, the cylinder specific wall flow correction amount CHOSn is set small when fuel supply is restarted. As a result, the cylinder specific fuel injection amount CTIn is reduced when fuel injection is restarted, the generated torque is suppressed, a sudden torque is avoided, and the driver and passengers do not experience a shock.

The reduction due to FCRATE is applied only to the initial injection in each cylinder after fuel supply is restarted, and as FCRATE is set to 1.0 in the second and subsequent injections in each cylinder, it has no effect on the calculation of the cylinder specific wall flow correction amount CHOSn. In the second and subsequent injections, as part of the burnt gas remains in the combustion chamber as described above, a cylinder specific wall flow correction amount with FCRATE=1.0 is applied, so the air fuel ratio rapidly reaches the target air-fuel ratio. Hence, according to this invention, shocks are avoided without any loss of engine speed.

Figures 8A, 8B, 8C:
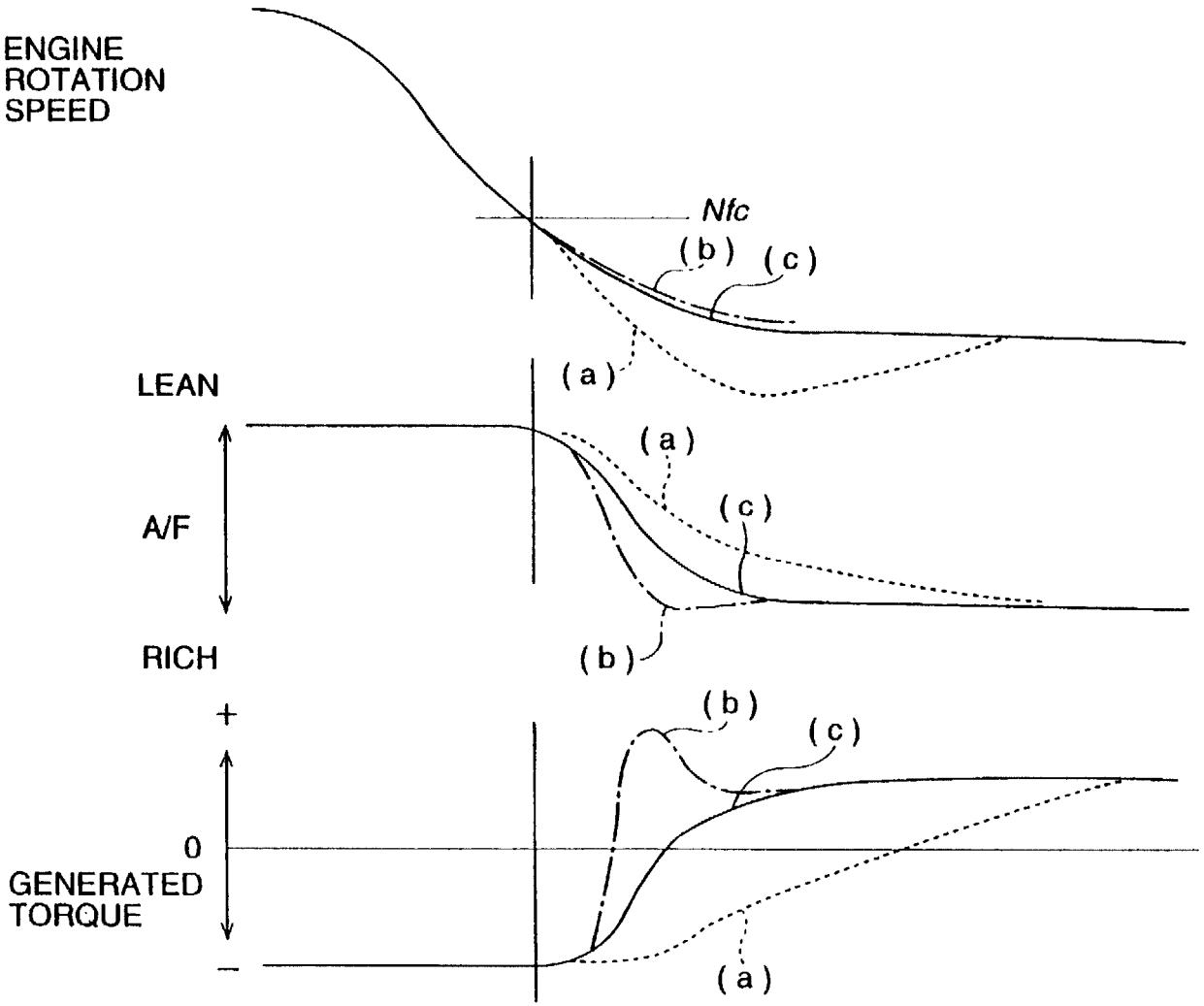
FIGS. 8A–8C are timing charts showing the variation of engine speed, air-fuel ratio and generated torque when fuel injection is restarted under the fuel injection control by the controller.

FIGS. 8A–8C show the variations of engine speed, air-fuel ratio and generated torque after fuel supply is restarted according to this fuel injection controller.

A broken line (a) shows the case when the fuel injection amount is not corrected by the cylinder specific wall flow correction amount CHOSn. In this case, as the fuel injection amount is not increased by the wall flow correction amount when fuel injection is restarted, engine speed falls after restarting injection as shown in FIG. 8A.

A dotted line (b) shows the case where the fuel injection amount is corrected by the cylinder specific wall flow correction amount CHOSn, however the fuel injection restart correction coefficient FCRATE is not taken into account in the calculation of the cylinder specific wall flow correction amount CHOSn, i.e. FCRATE is always set to 1.0. In this case, decrease of engine speed is prevented as shown in FIG. 8A by increasing the fuel supply when fuel injection is restarted, however an excessive torque is produced immediately after injection as shown in FIG. 8C.

A solid line (c) shows the case of this invention where FCRATE is set small only immediately after restarting fuel injection. In this case, not only is decrease of engine speed prevented but also an excessive torque is not generated after fuel injection is restarted.

Figure 9:
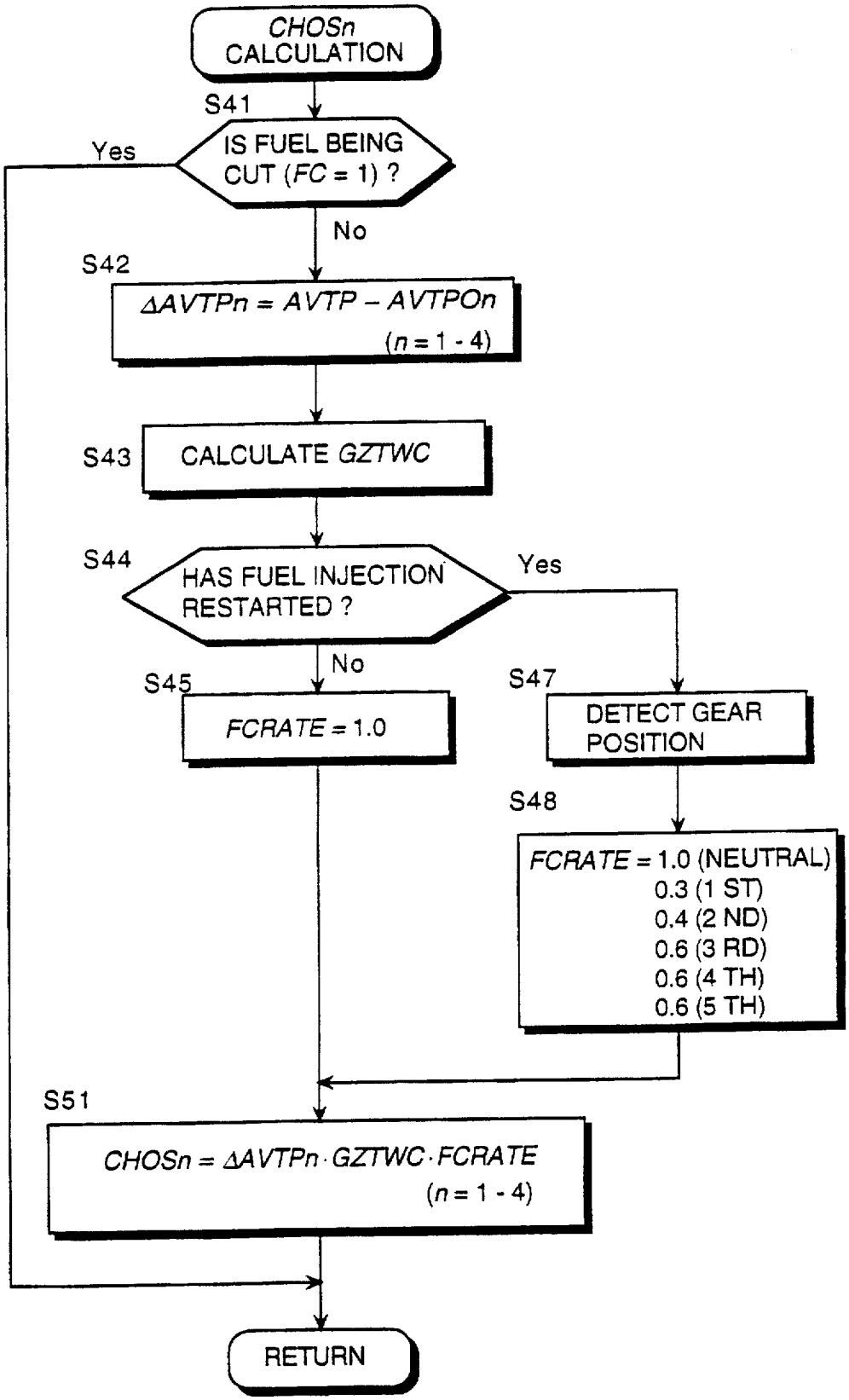
FIG. 9 is similar to FIG. 6, but showing a second embodiment of this invention.

FIG. 9 shows a second embodiment of this invention. This relates to another process for calculating the cylinder specific wall flow correction amount CHOSn which is executed instead of the process of FIG. 6.

According to this process, steps S47 and S48 are provided instead of the step S46 of FIG. 6, and the set value of FCRATE after restarting fuel injection is varied according to a gear position.

In the step S47, the present gear position is detected by a signal from a gear position sensor 16. In the step S48, the fuel injection restart correction coefficient FCRATE is set according to the gear position as shown below:

Neutral: FCRATE=1.0
First gear: FCRATE=0.3
Second gear: FCRATE=0.4
Third gear: FCRATE=0.6
Fourth gear: FCRATE=0.6
Fifth gear: FCRATE=0.6

Even when an excessive shock is produced in neutral, the driver and passengers experience hardly any shock so emphasis can be put on preventing drop of engine rotation speed. In other gear positions, the shock transmitted to the driver and passengers is greater the lower the gear, so FCRATE is set to a smaller value the lower the gear.

Figure 10:
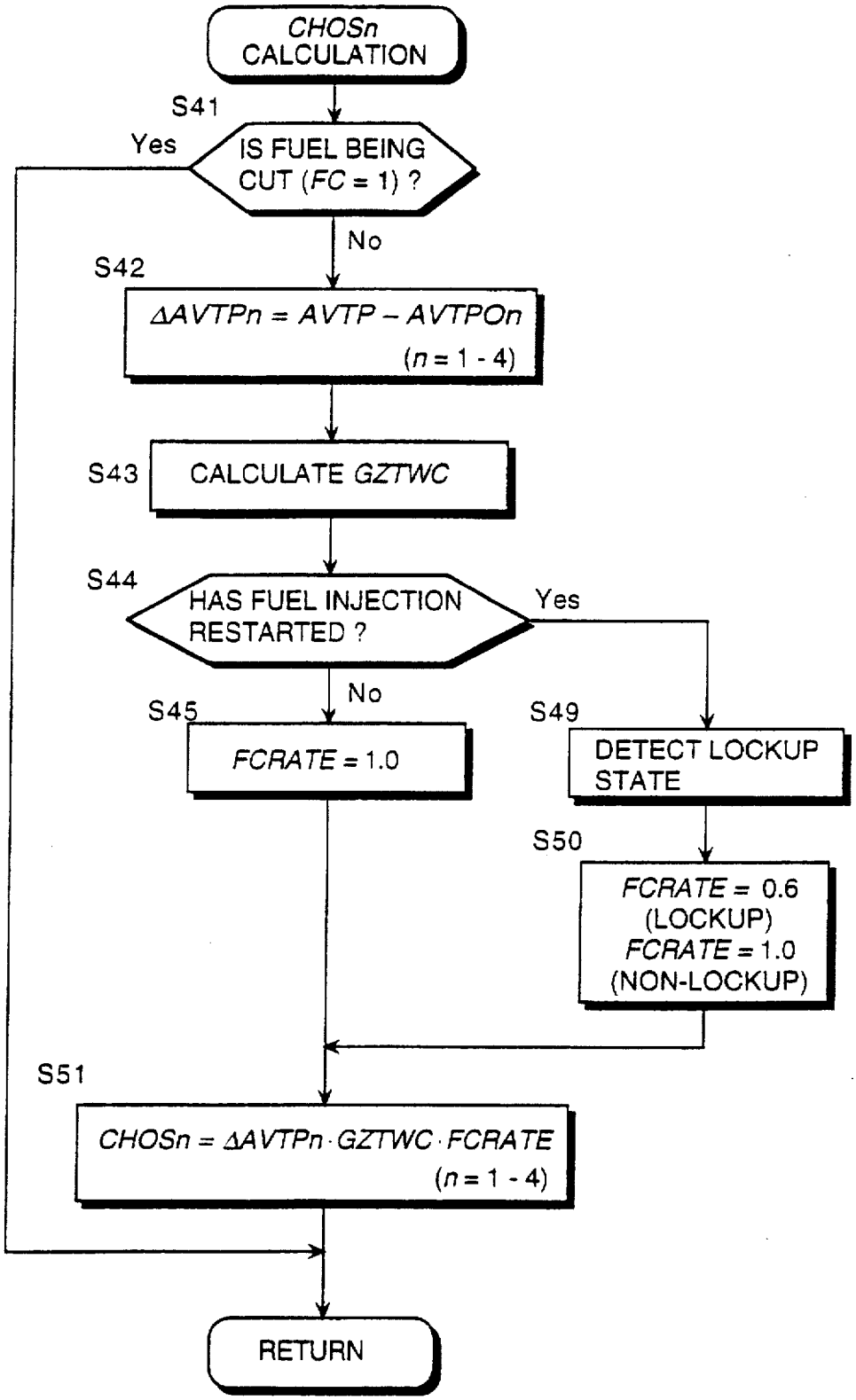
FIG. 10 is similar to FIG. 6, but showing a third embodiment of this invention.

FIG. 10 shows a third embodiment of this invention. This embodiment also relates to the process of calculating the cylinder specific wall flow correction amount CHOSn, and is performed instead of the process of FIG. 6.

According to this process, steps S49 and S50 are provided instead of the step S46 of FIG. 6. Here, the setting of FCRATE is varied according to the operating state of the lockup clutch of the torque converter.

In the step S49, the lockup state is detected by a signal from the lockup switch 17. In the step S50, FCRATE is set as follows according to this detection result.

During lockup: FCRATE=0.6
Not during lockup: FCRATE=1.0

During lockup, shocks are easily produced, so emphasis is placed on preventing shock. When there is no lockup, shocks are hardly transmitted, so emphasis is placed on preventing drop of engine rotation speed. The construction of converters which transmit rotation via a fluid is such that shocks are not easily transmitted when there is no lockup.

It will be understood that the values of FCRATE given in the above description are only examples, and other values may of course be assigned within the spirit and scope of the appended claims.

This invention has been described in the context of its application to synchronous injection at a predetermined crank angle, however it may also be applied to a fuel injection controller comprising an interrupt system where asynchronous injection is performed, i.e. where injection is interrupted when fuel injection is restarted so that an asynchronized injection that is not synchronized with the crank angle is performed.

The embodiments of this invention in which an exclusive property or privilege is claimed are defined as follows:

1. A fuel injection controller for use in conjunction with an engine comprising a cylinder, a fuel injector which performs fuel injection in synchronism with a combustion cycle of said cylinder and means for stopping said fuel injection under a predetermined engine running condition, said controller comprising:

means for calculating a cylinder air volume equivalent fuel injection amount corresponding to an air volume aspirated into said cylinder, means for calculating a wall flow correction amount, means for calculating a final fuel injection amount from said cylinder air volume equivalent fuel injection amount and said wall flow correction amount, means for controlling said fuel injector such that said injector injects said final fuel injection amount, and means for decreasing said final fuel injection amount in the initial injection when fuel injection is restarted after fuel injection is stopped by said stopping means.

2. A fuel injection controller as defined in claim 1, wherein said controller further comprises means for detecting an engine cooling water temperature and means for calculating a fuel injection restart correction coefficient of which the value is different in said initial injection and in other injections, and said wall flow correction amount calculating means comprises means for calculating a variation of said cylinder air volume equivalent fuel injection amount, means for calculating a water temperature correction coefficient according to the engine cooling water temperature, and means for computing a wall flow correction amount in said cylinder from said variation, water temperature correction coefficient and fuel injection restart correction coefficient.

3. A fuel injection controller as defined in claim 2, wherein said means for calculating a variation of said cylinder air volume equivalent fuel injection amount comprises means for storing a cylinder air volume equivalent fuel injection amount calculated for the previous fuel injection means for calculating a difference between said cylinder air volume equivalent fuel injection amount calculated for a present injection and said cylinder air volume equivalent fuel injection amount stored by said storing means and means for progressively decreasing said cylinder air volume equivalent fuel injection amount stored by said storing means as the combustion cycle proceeds during a period in which fuel injection is stopped by said stopping means.

4. A fuel injection controller as defined in claim 1, wherein said engine is connected to a transmission, said controller further comprises means for detecting a gear position of said transmission, and said decreasing means comprises means for correcting said wall flow correction amount such that said final injection amount becomes smaller the lower the gear position used.

5. A fuel injection controller as defined in claim 1, wherein said engine further comprises a torque converter comprising a lockup clutch, said controller further comprises means for detecting lockup of said lockup clutch, and said decreasing means comprises means for correcting said wall flow correction amount such that said final injection amount is smaller during lockup.

* * * * *